United States Patent [19]

Krakow

[11] 4,379,487

[45] Apr. 12, 1983

[54] INTERMESHING PASSAGE MANIFOLD

[76] Inventor: Kalman Krakow, 102 Radcliffe Rd., Montreal West, Quebec, Canada, H4X 1C2

[21] Appl. No.: 252,930

[22] Filed: Apr. 10, 1981

[51] Int. Cl.[3] ..... F28F 9/02

[52] U.S. Cl. ..... 165/165; 165/166

[58] Field of Search ..... 165/166, 167, 158, 7; 159/18 P

[56] References Cited

U.S. PATENT DOCUMENTS

| | | | |
|---|---|---|---|
| 213,635 | 3/1979 | Drache | 165/166 |
| 2,314,966 | 3/1943 | Astle | 165/167 |
| 4,116,271 | 9/1978 | Lebeleire | 165/166 |

*Primary Examiner*—William R. Cline
*Assistant Examiner*—Theophil W. Streule, Jr.
*Attorney, Agent, or Firm*—Bernard Malina

[57] ABSTRACT

An intermeshing passage manifold is a device for subdividing each of two passages of ducts connected to it into multiple adjacent separate intermeshed passages. The intermeshing passage manifold is to be used for heat exchangers and fluid mixing devices in order to minimize pressure (energy) losses and to satisfy geometric constraints in many applications. The intermeshing passage manifold consists of a number of manifold sections adjacent in an end-to-end manner. Each of the manifold sections consists of a number of passage modules adjacent in a side-by-side manner. Each passage module consists of two passages; the orientation of these passages at one end of a module is at right angles to the orientation of the passages at the other end of the module, however, the cross-section shape of the module remains the same throughout its length. The change in orientation of the passages within the passage module is effected by means of a flowguide partition which is a multiplanar and/or contoured partition bound by six lines, each of these lines lying in one of each of the four enveloping side partitions and in each of the end planes of the passage module. Successive manifold sections have increasing numbers of passage modules so that each passage module of a manifold section is aligned with an integral number of passage modules of the following manifold section.

7 Claims, 31 Drawing Figures

FIG 17a
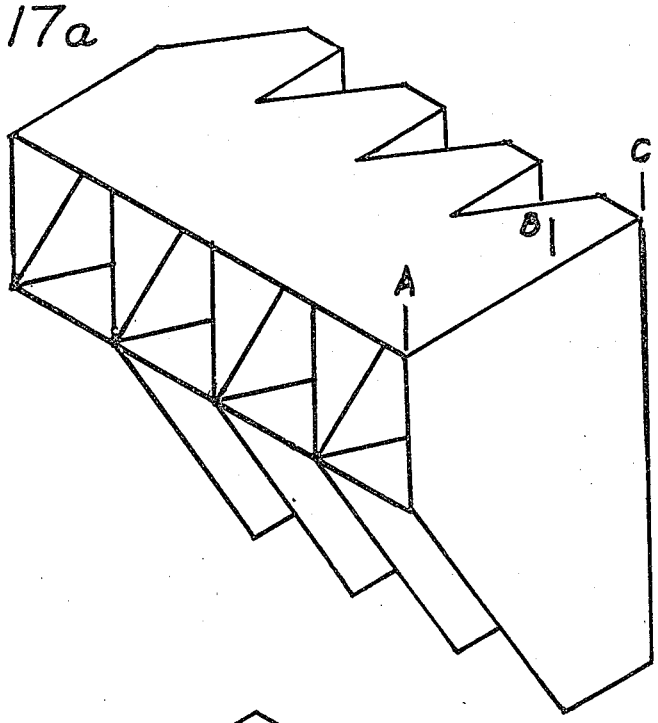
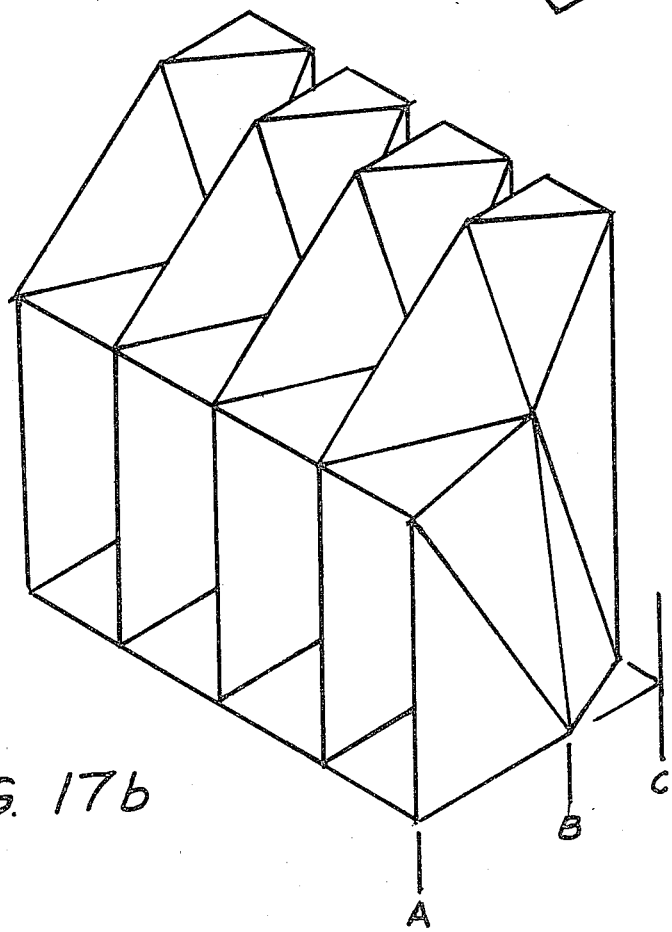
FIG. 17b

INTERMESHING PASSAGE MANIFOLD

This invention entitled "intermeshing passage manifold" relates to a device for subdividing two passages (in which fluids flow) into multiple separate adjacent intermeshed passages. The manifold is to be used for heat exchangers and fluid flow mixing devices. It will be used in solving design problems involving physical (geometric) constraints and increasing the efficiency of equipment by minimizing its resistance to flow, i.e. reducing pressure losses.

The geometry of a heat exchanger determines where it can be used physically, its resistance to the flow through it, and its heat transfer effectiveness. Heat exchangers embodying intermeshing passage manifolds will enable heat exchanger designs for applications in which conventional designs are not suitable and/or will have less resistance to the flow than conventional designs. For example, the theory of the use of heat exchangers in gas turbine cycles is well documented in the literature on fluid machinery, however, no practical heat exchanger design has been perfected. In such possible heat exchanger applications high pressure losses of conventional heat exchangers negate the benefits that would be derived from the energy recovered by a heat exchanger. Heat exchangers embodying intermeshing passage manifolds will offer a practical solution not only because of their possible annular cross-section but also because of the anticipated low resistance to flow.

Flow mixing devices for industrial processes or environmental control systems embodying an intermeshing passage manifold will be more compact and will have lower resistance to flow than conventional mixing devices.

In the drawings which illustrate embodiments of this invention:

FIGS. 1, 2, 3, and 4 are cross-sectional views showing W, X, Y, and Z configurations, respectively, of inlet/-outlet cross-sections of a module.

FIGS. 5, 6, and 7 are three dimensional representations of multiplanar flowguides in passage modules having WY, YW, and YZ configurations, respectively.

Figure 11:
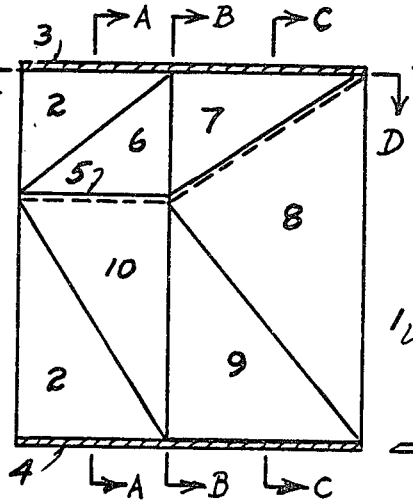
FIG. 11 is an orthographic front sectional view taken along the line EE of FIG. 9 of the WY multiplanar flowguide passage module.
Figure 12:
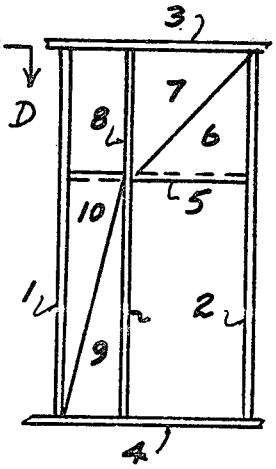
FIG. 12 is an orthographic right side view of the WY multiplanar flowguide passage module outlet.
Figure 13:
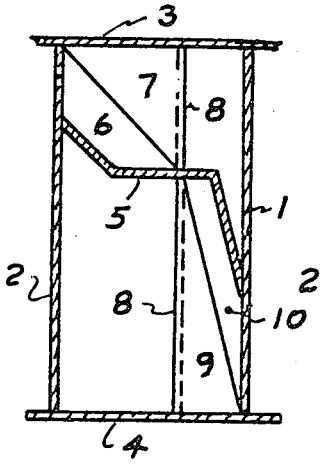
Figure 14:
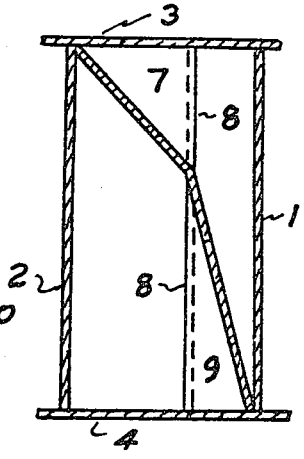
Figure 15:
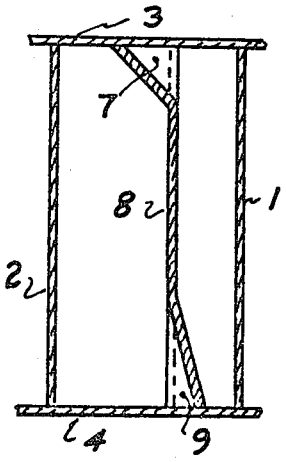

FIGS. 13, 14, and 15 are cross-sectional views taken along lines AA, BB, and CC of FIG. 11, respectively.

Figure 16:
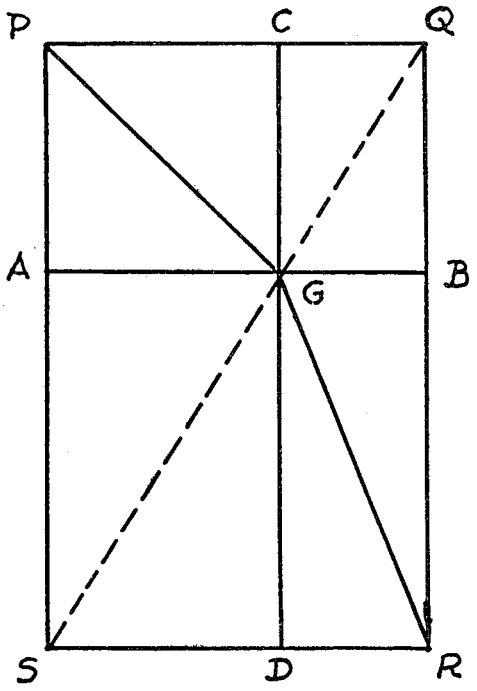

FIG. 16 is a composite cross-sectional view superimposing inlet, outlet, and intermediate planes of a WY passage module showing points required for geometric analysis.

FIGS. 17*a* and 17*b* are exploded pictorial views showing upper and lower passages, respectively, of a single section manifold having passage modules with multiplanar flowguide partitions.

Figure 18:
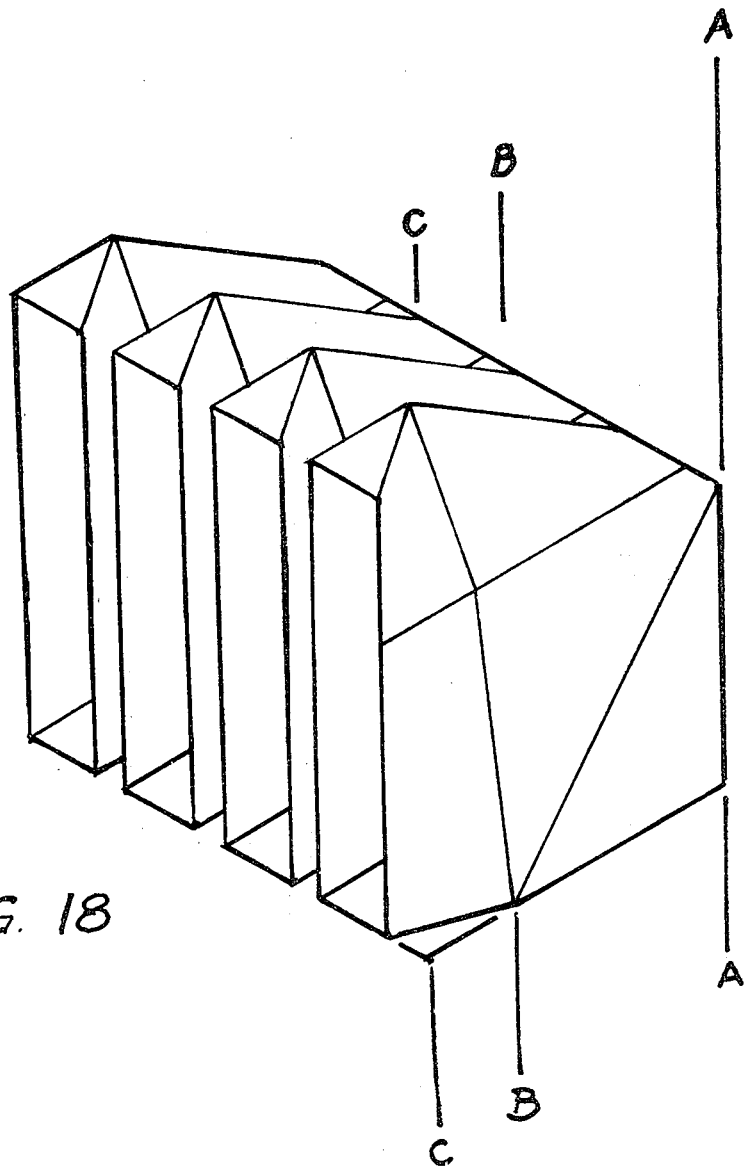

FIG. 18 is a pictorial view showing the lower passage of a single section manifold having passage modules with contoured flowguide partitions.

Figure 19:
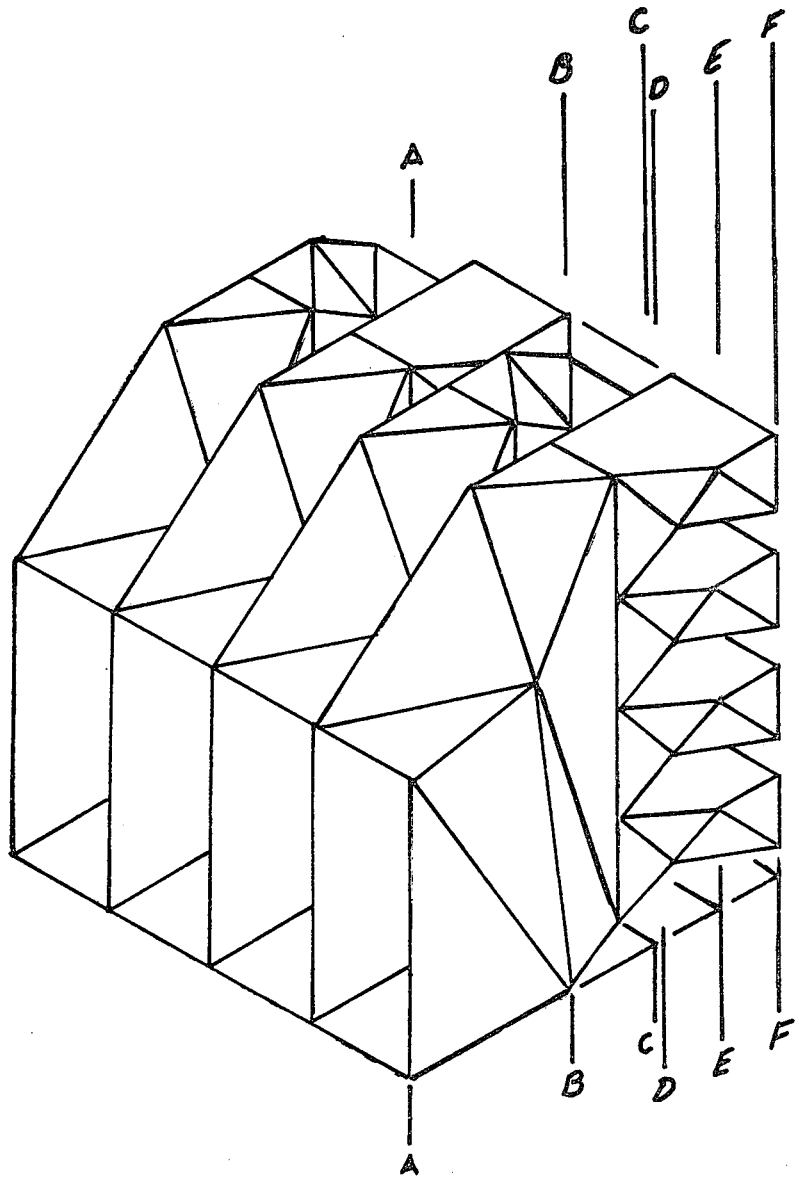

FIG. 19 is a pictorial view showing the lower passage of a two section manifold having passage modules with multiplanar flowguide partitions.

Figure 22:
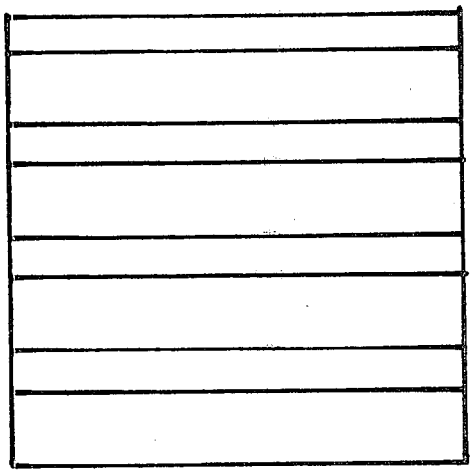
Figure 21:
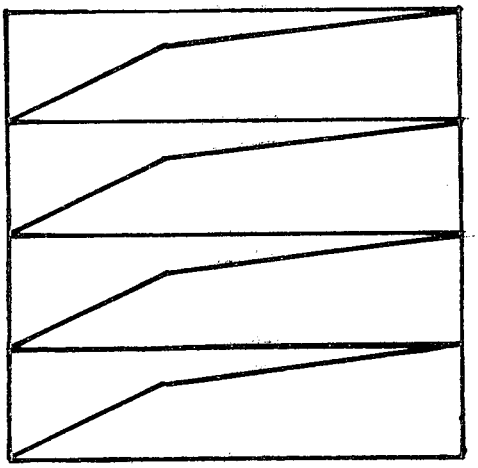
Figure 20:
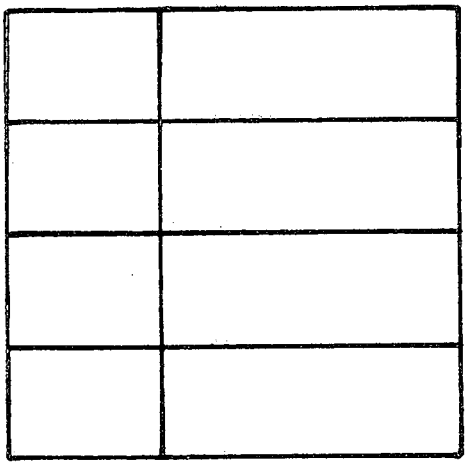

FIGS. 20, 21, and 22 are views showing passage cross-sections through lines AA, BB and CC, respectively, of FIGS. 17*a* and 17*b*, FIG. 18, and FIG. 19.

Figure 25:
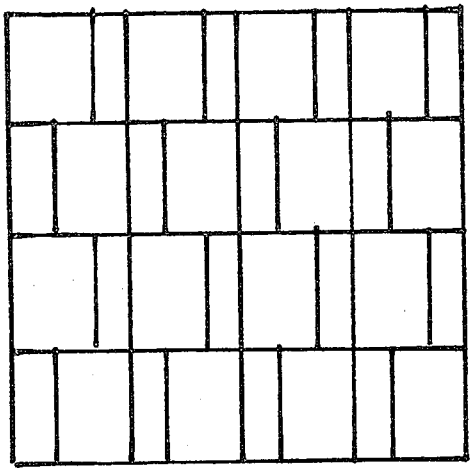
Figure 24:
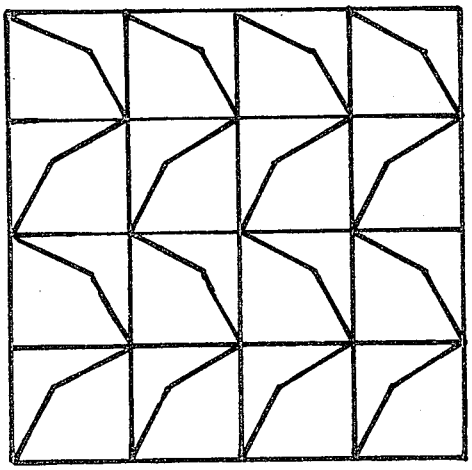
Figure 23:
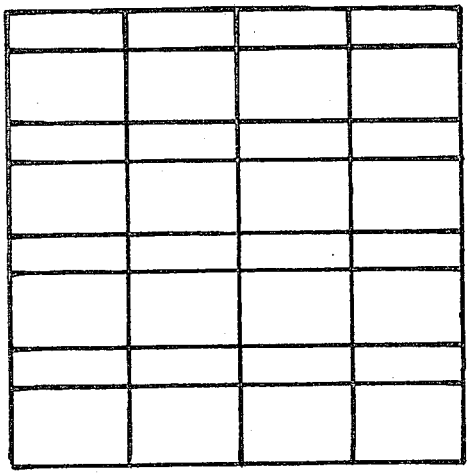

FIGS. 23, 24, and 25 are views showing passage cross-sections through lines DD, EE, and FF, respectively, of FIG. 19.

Figure 26:
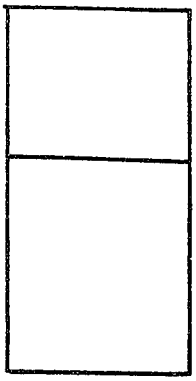

FIG. 26 is a cross-sectional view of the inlet/outlet of a rectangular module.

Figure 27:
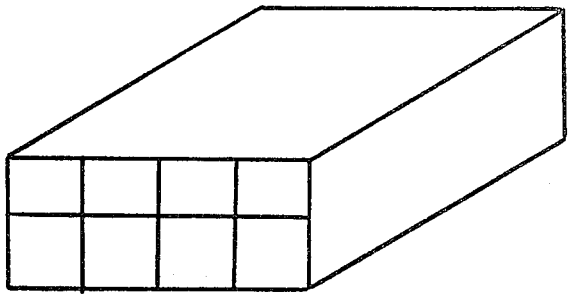

FIG. 27 is a pictorial view of the combination of rectangular modules to form an intermeshing passage manifold for two rectangular parallel ducts.

Figure 28:
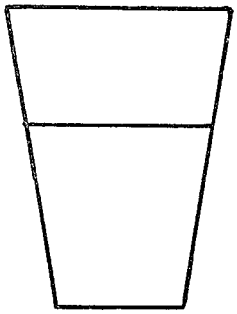

FIG. 28 is a cross-sectional view of the inlet/outlet of a trapezoidal module.

Figure 29:
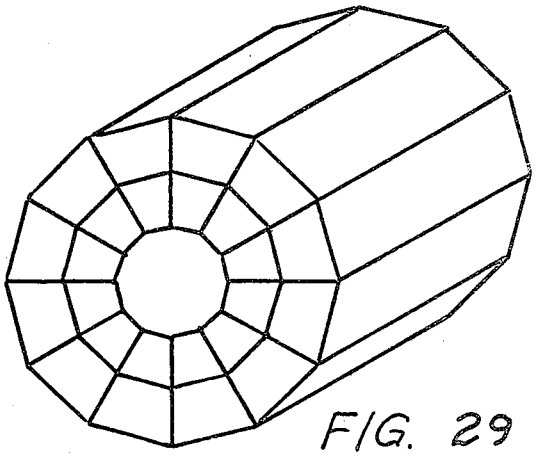

FIG. 29 is a pictorial view of the combination of trapezoidal modules to form an intermeshing passage manifold for two concentric polygonal ducts.

Figure 30:
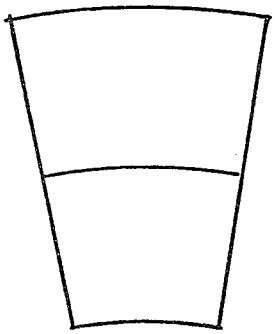

FIG. 30 is a cross-sectional view of the inlet/outlet of a circular segment module.

Figure 31:
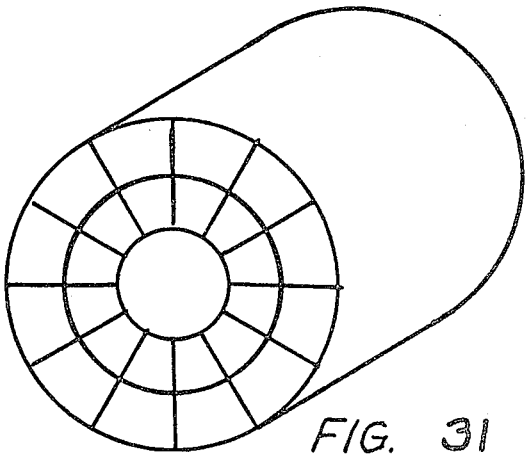

FIG. 31 is a pictorial view of the combination of circular segment modules to form an intermeshing passage manifold for two concentric annular ducts.

An intermeshing passage manifold comprises of one or more manifold sections adjacent in an end-to-end manner, each manifold section comprises a number of passage modules adjacent in a side-by-side manner, each passage module consists of a pair of adjacent twisted passages separated by a partition termed a flowguide. The orientation or relative position of the two passages at each end of a passage module is different. For example, two passages may be oriented top-to-bottom at the inlet of the passage module and oriented side-by-side at the outlet of the module. The configuration of a passage module is defined in terms of the orientation or relative positions of the two passages at both ends of the module. Each passage module of a manifold section has the same geometric cross-sectional shape and size, however, the passage configuration of passage modules within a manifold section may vary. The configuration of passages within the passage modules, the arrangement of modules within a manifold section, and the arrangement of manifold sections within an intermeshing passage manifold combine to determine the overall geometric structure of the intermeshing flow manifold.

A passage module consists of two separate adjacent twisted passages such that the cross-sectional orientation of these passages at one end of the module is substantially at right angles to the cross-section orientation of the passage at the other end of the passage module. For example the passages may be oriented as an upper and a lower passage at one end, and as a left side and a right side passage at the other end. The possible cross-sectional configurations of the inlet and outlet planes of a passage module are shown in FIGS. 1, 2, 3, and 4 and are designated W, X, Y and Z respectively. The two passages may or may not have equal cross-sectional areas. In order to distinguish easily between the two passages one is shown larger than the other. In order to distinguish between the two fluids involved in a heat transfer process or a mixing process, one fluid is termed the hot fluid and the other the cold fluid. Consider, for example, that the hot fluid flows through the passage having the smaller cross-sectional area and the cold fluid flows through the passage having the larger cross-sectional area. Configuration W represents the subdivision of the flow area into an upper and a lower passage such that the hot fluid flows through the upper passage and the cold fluid flows through the lower passage. Configuration X represents the subdivision of the flow area into a left side and a right side passage such that the hot fluid flows through the left passage and the cold fluid flows through the right passage. Configuration Y represents the subdivision of the flow area into a left side and a right side passage such that the hot fluid flows through the right passage and the cold fluid flows through the left passage. Configuration Z represents the subdivision of the flow area into an upper and a lower passage such that the hot fluid flows through the lower passage and the cold fluid flows through the upper passage.

The configuration of a passage module shall be denoted by the configurations of its end (inlet, outlet) planes. A passage module may have one of eight configurations, as tabulated below.

| inlet cross-sectional configuration | outlet cross-sectional configuration | passage module configuration |
|---|---|---|
| W | X | WX |
| W | Y | WY |
| X | W | XW |
| X | Z | XZ |
| Y | W | YW |
| Y | Z | YZ |
| Z | X | ZX |
| Z | Y | ZY |

For example, a WX passage module has an inlet plane having a W cross-sectional configuration and an outlet plane having a X cross-sectional configuration.

The partition between the two passages of a passage module shall be termed the flowguide. The four partitions, which separate a passage module from the adjacent passage modules which make up a manifold section, or which form part of the exterior wall of the manifold section, shall be termed the bounding partitions of the passage module and they shall be denoted as the left side, the right side, the upper, and the lower partitions, in order to differentiate between them. The part of a bounding partition which has the same (hot or cold) fluid flowing on both its sides, may be omitted.

A flowguide shall consist of a contoured and/or multiplanar surface bounded by six straight and/or curved lines. The six bounding lines shall be lines of intersection of the flowguide with the four bounding partitions of the passage module, and the two end planes, the inlet and outlet planes, of the passage module. The intersection of two (bounding) lines define a point. A point is also defined by the intersection of a minimum of three surfaces or planes. The six points, to be termed key points, which when joined by six straight and/or curved lines, bound the flowguide, are shown in FIGS. 5, 6, 7 and 8, and are defined as follows.

The intersection point A of the flowguide, one end plane and the left side partition of the passage module.

The intersection point B of the flowguide, the foregoing end plane, and the right side partition of the passage module.

The intersection point C of the flowguide, the other end plane, and the upper or lower partition of the passage module.

The intersection point D of the flowguide, the foregoing end plane, and the lower or upper partition of the passage module.

The intersection point E of the flowguide, the left surface of the passage module, and either an upper and lower partition of the passage module. This point may lie in an intermediate plane between and parallel to the end planes.

The intersection point F of the flowguide, the right side partition of the passage module, and either the lower or upper partition of the passage module such that this point F lies diagonally across from the foregoing point E. This point F may lie in the same intermediate plane as the foregoing point, E.

A flowguide is bound by six straight and/or curved lines, AB, BF, FD, DC, CE, and EA, which join the key points A to B to F to D to C to E to A.

Curved and/or straight lines may join the key points. For simplicity of illustration only, the key points will be joined by straight lines. The flowguide partition may be a multiplanar i.e. comprise of adjacent flat surfaces and/or it may be contoured. For simplicity of illustration only, most figures will show multiplanar flowguide partitions.

Multiplanar flowguide modules of WY, YW, and YZ configurations and a contoured flowguide module of YW configuration are shown in FIGS. 5, 6, 7 and 8 respectively.

Figure 5:
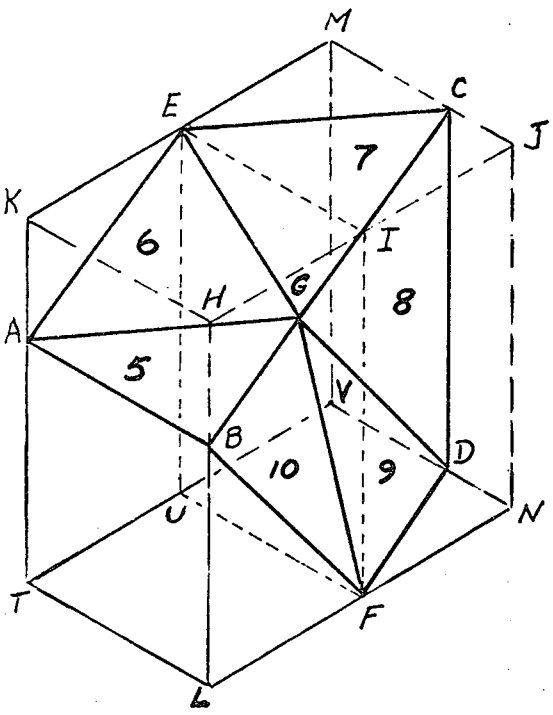
Figure 9:
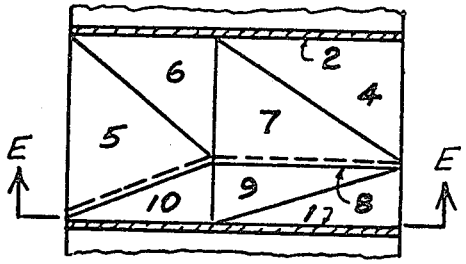
FIG. 9 is an orthographic top sectional view taken along the line DD of FIG. 11 of a WY multiplanar flowguide passage module.
Figure 10:
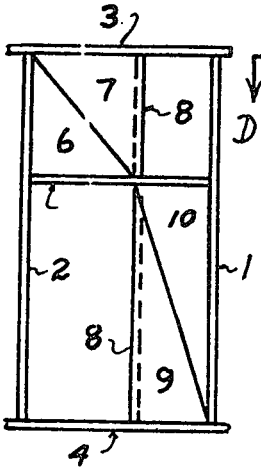
FIG. 10 is an orthographic left side view of the WY multiplanar flowguide passage module inlet.

Orthographic views of a WY configuration of a multiplanar flowguide module are shown in FIGS. 9, 10, 11 and 12. Cross-sectional views of the module are shown in FIGS. 13, 14, and 15. Each module consists of a right side partition 1, a left side partition 2, an upper partition 3, a lower partition 4, and a multiplanar flowguide consisting of six triangles 5, 6, 7, 8, 9, and 10. (FIG. 5 and FIGS. 9 and 15). Under some geometric conditions some of the triangles may lie in the same plane, for example, if the upper and lower passages have equal cross-sectional areas and the intermediate plane, represented by section line BB in FIG. 11 and FIG. 14, is midway between the inlet and outlet planes, triangles 6, 7, 9 and 10 will lie in the same plane. The geometry of the multiplanar flowguide is such that all six triangles have one common point, G, each triangle has two sides in common with two adjacent triangles, one triangle 5 lies in a plane parallel to the upper and lower partitions, another triangle 8 lies in a plane parallel to the side partitions, two of the remaining triangles 6 and 10 each have one side in common with a side partition and one side in common with the triangle designated 5, the two remaining triangles 7 and 9 each have one side in common with an upper and lower partition and one side in common with the triangle designated 8. Although the foregoing description is referenced to a WY module, the description is valid for a multiplanar flowguide in general.

A flowguide may be constructed, not only with multiple flat planar surfaces, but also with a continuously contoured surface and with a combination of flat planar and contoured surfaces, within the six bounding lines as previously defined. The six bounding lines may be straight lines and one or more of the flat planar surfaces of a multiplanar flowguide may be replaced with an equal or smaller number of continuously contoured surfaces. One or more of the six bounding lines and/or one or more of the six straight lines joining two flat surfaces of a flowguide may be curved and the surfaces of the flowguide containing them contoured as required. In order to obtain a gradual transition between two flat and/or contoured surfaces, a fillet radius may be used. The fillet radius may vary along the length of the junction. Regardless of the manner in which a flowguide is constructed, it is defined by the six key points and bound by six straight and/or curved lines. A contoured flowguide partition bound by six straight lines defined identically to those bounding the multiplanar flowguide partition shown in FIG. 6 but consisting of four contoured sectors instead of six plane triangles is shown in FIG. 8.

If it is desired to maintain constant cross-sectional area in each of the passages throughout the length of the passage module, the geometry must satisfy the following conditions. Using the geometry of a WY module as an example, consider the superimposed cross-sections of the inlet plane and the outlet plane as shown in FIG. 16. Point G is defined as that point on the flowguide which is the intersection point of lines AB and CD when the inlet and outlet planes are superimposed as in FIG. 16. Point G is common to all six triangles of the multiplanar flowguide modules illustrated in FIGS. 5, 6, and 7 and to all four contoured sectors of the contoured flowguide module illustrated in FIG. 8. Designating the corner points as P, Q, R, and S, PQRS represents the total area of the two passages, PQBA represents the inlet area of the upper passage, ABRS, the inlet area of the lower passage CQRD represents the outlet area of the upper passage, and PCDS represents the outlet area of the lower passage. In order to maintain the proportion of the cross-sectional area in the passages constant, the intersection point G of the lines separating upper and lower areas, AB, and the line separating side by side areas, CD, must lie in one of the diagonals, QS in this example. The flowguide must be such that it is contained in areas (PCGA and GBRD in this example) not containing the foregoing diagonal (QS in this example) and the areas (CQBG and AGDS in this example) containing the forementioned diagonal (QS in this example) do not have any part of the flowguide. The diagonal on which the intersection point G is taken QS or PR depends on the exact inlet and outlet configurations desired, e.g. upper passage to right side passage, or uppe passage to left side passage, etc., the basic geometry is similar for all configurations.

That point passing through point G and parallel to the inlet/outlet planes is defined as the intermediate plane.

Figure 8:
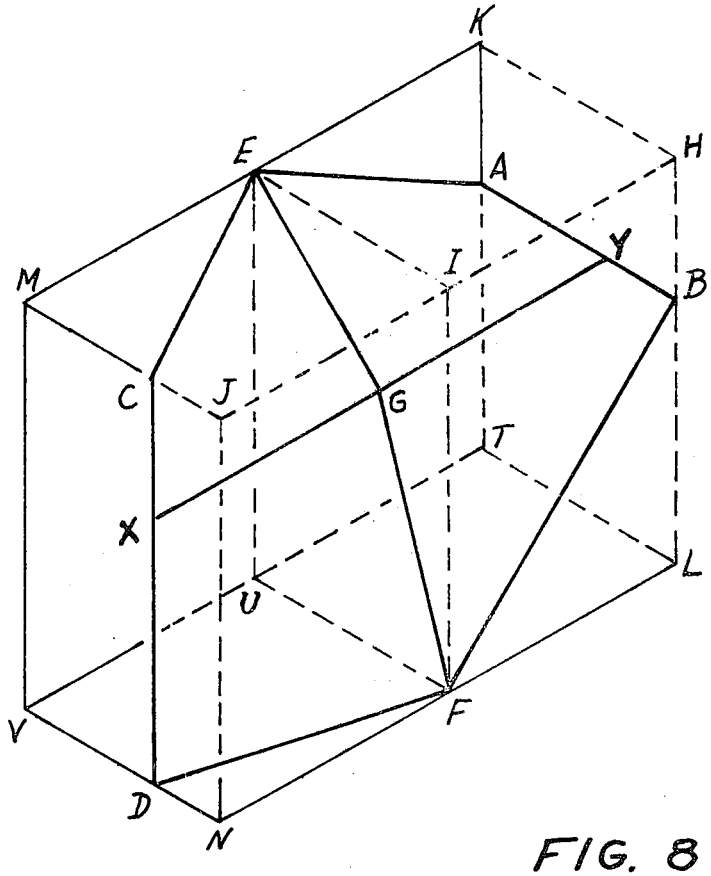
FIG. 8 is a three dimensional representation of a contoured flowguide in a passage module having a YW configuration.

In the sample passage module shown in FIG. 8 each sector of the flowguide partition is a contoured surface bound by four straight lines; a bounding line (AE, EC, BF, DF) of the flowguide partition which lies in a bounding partition of the module, a bounding line (AB, CD) of the flowguide partition which lies in the inlet or outlet plane of the module, an axial line XY which is perpendicular to both the inlet and outlet planes and passes through point G (previously defined), and a line (EG, FG) which lies in the intermediate plane (EIFU, previously defined) and is perpendicular to the axial line at point G and to the line of intersection of two of the bounding partitions of the module.

It is evident that the contoured flowguide partition shown in FIG. 8 may be replaced by a multiplanar flowguide partition having eight adjacent triangles, XCE, XGE, EAY, EGY, XDF, XGF, YBF, and YGF.

A manifold section is a series of passage modules integrally combined in a side-by-side manner such that adjacent passages may carry the same (hot or cold) fluid at one end and that no two adjacent passages may carry the same (hot or cold) fluid at the other end. This is accomplished by the appropriate selection of the configurations of each passage module. The appropriate selection is dependent on the number of manifold sections in an intermeshing passage manifold as well as the size and cross-sectional shape and the configuration of the ducts to be connected to the manifold.

A manifold may comprise of a single manifold section or a number of manifold sections adjacent in an end to end manner. The flow passages within a single section manifold is illustrated in FIGS. 17*a* and 17*b* which show an exploded view of the upper and lower flow passages. FIGS. 20, 21 and 22 show the cross-section of the flow passages at sections AA, BB, and CC, respectively, of FIGS. 17*a*, 17*b*, and 18. The manifold section, in this case, consists of four WY modules having multiplanar flowguide partitions as illustrated in FIG. 5. FIG. 18 illustrates the lower flow passage of another manifold. In this case the manifold consists of four YW modules having flowguide partitions as illustrated in FIG. 8. The contoured partition used in the example of FIG. 18 is one of many non-planar flowguide partitions possible.

It should be noted that one end of a single section manifold is such that when two ducts are connected to it, the two passages defined by the ducts will be subdivided into separate adjacent intermeshed passages at the other end of the intermeshing passage manifold. The manifolds illustrated by FIGS. 17*a* and 17*b* and FIG. 18 will subdivide two passages which would be ducts connected to the front end of the manifold illustrated in FIGS. 17*a* and 17*b* or to the back end of the manifold illustrated in FIG. 18 into four separate adjacent intermeshed passages.

In manifolds consisting of two or more manifold sections, the first or primary section is similar to a single section manifold, each successive or secondary manifold section consists of a larger number of passage modules, hence passages, than the previous one such that each passage module of one section is subdivided into an integral number of passage modules within the successive section. FIG. 19 illustrates the lower flow passage of a two section manifold. The first section to which ducts would be connected consists of four WY modules (having multiplanar flowguide partitions similar to that illustrated in FIG. 17) arranged side-by-side in one layer. The other section consists of sixteen modules (having multiplanar flowguide partitions) arranged in four layers. Eight of these modules are YW modules and eight are YZ modules. FIGS. 20 to 25 show the cross-sections of the flow passages at section AA, BB, CC, DD, EE, and FF, respectively, of FIG. 19. This manifold will therefore subdivide two passages which would be duct connected to the first section into 32 separate adjacent intermeshed passages as shown in FIG. 25. Additional flow guiding sections may be added, if desired, to further subdivide the 32 passages.

Thus an intermeshing passage manifold containing more than one manifold section consists of a primary manifold section containing one layer of passage modules and a plurality of secondary manifold sections which contain a plurality of layers of passage modules. Each successive section contains a larger number of passage modules than the preceding section. Each passage module of a section is aligned with an integral number of passage modules of the section which follows it. The configuration of the passages within the passage modules is such that when two ducts, one conveying a hot fluid and one conveying a cold fluid, are connected to one end of the manifold, the two passages defined by these ducts will be subdivided into multiple adjacent intermeshed passages at the other end of the manifold.

Figure 4:
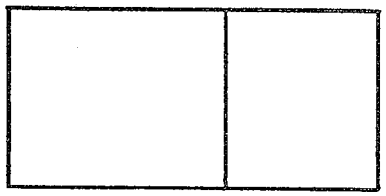
Figure 3:
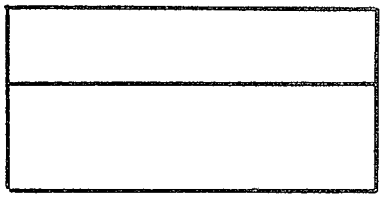
Figure 2:
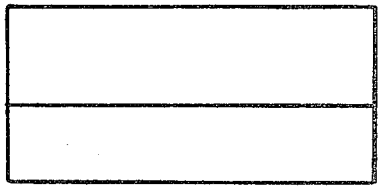
Figure 1:
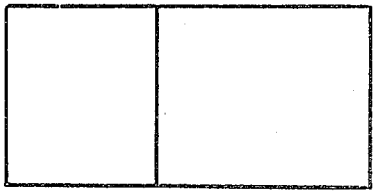
Figure 7:
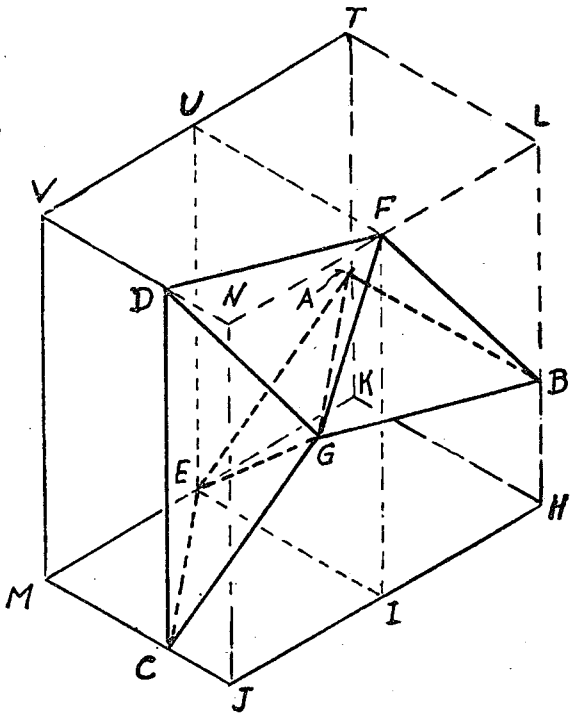
Figure 6:
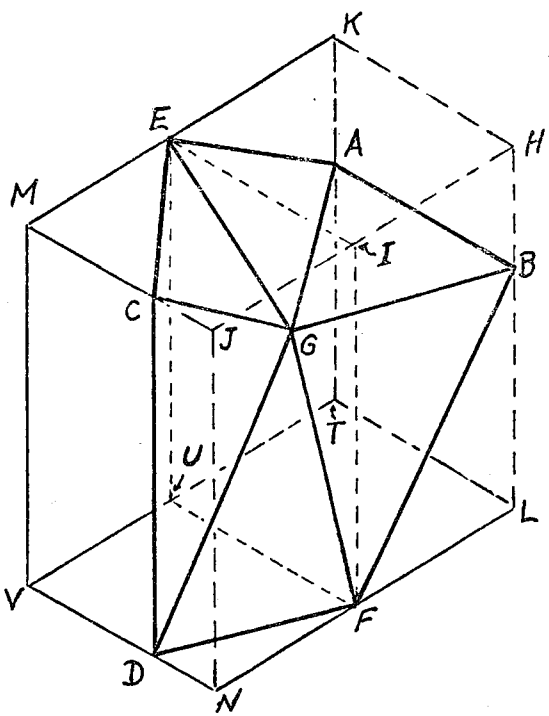

In a series of adjacent modules, the part of a bounding partition which has the same (hot or cold) fluid flowing on both its sides, may be omitted. For example, if multiplanar flowguide modules as illustrated in FIGS. 5, 6, and 7 are placed side to side with modules of the same configuration, the triangles AEK, BIH, BFL, and AUT may be omitted from the bounding side partitions; if the modules are placed top to bottom with modules of the same configuration, the triangles CEM, DUV, DFN, and CIJ may be omitted from the bounding upper and lower partitions. (In the foregoing figures, points H, I, J, K, L, M, N, T, U, and V denote intersection points of the end (inlet/outlet) planes and the intermediate plane (in multiplanar flowguide modules only) and the bounding partitions.)

The basic geometry of a module may be distorted or transformed so that the cross-sectional area of one or both passages varies with distance along the intermeshing passage manifold. Further it is not mandatory that the ratio of the cross-sectional areas of the two passages of a module be constant with the distance along the intermeshing passage manifold.

Although diagrams in FIGS. 1 to 21 show a module as having a rectangular cross-section, other cross-sections may be used. Rectangular cross-section modules, as shown in FIG. 20, combine to form rectangular intermeshing passage manifolds as shown in FIG. 21. Trapezoidal cross-section modules, as shown in FIG. 22, may be combined to form concentric polygonal intermeshing passage manifolds, as shown in FIG. 23. Circular segment cross-section modules, as shown in FIG. 24, may be combined to form concentric annular intermeshing passage manifolds, as shown in FIG. 25. The trapezoidal and circular cross-section modules are distortions or mathematical transformations of the rectangular cross-section module. A distortion is the curving of one or more lines and/or surfaces and/or the changing of one or more proportions between dimensions. The curving of some lines and surfaces of a flowguide are required, rather than optional, for concentric annular intermeshing passage modules.

Each application of an intermeshing flow manifold will require a specific variation of dimensions, number and arrangement of modules, cross-sectional shape, and flowguide partition geometry. Because of the modular structure of the intermeshing passage manifold, numerous variations are possible, however each variation will have to conform to the specified structural geometry as defined by the flowguide partition, the module, and the manifold sections which comprise the intermeshing passage manifold.

The construction of manifolds may be either by the fabrication from sheet material, by casting as a whole or by the casting in a number of transverse sections and assembling them. The manifolds may be constructed as an integral part of a mixing device or heat exchanger or as a separate component for a mixing device or heat exchanger.

Heat exchangers for transferring heat from a hot fluid to a cold fluid may be constructed by connecting an intermeshed passage heat exchanger core between two complimentary manifolds having corresponding separate adjacent intermeshed passages and connecting the ducts conveying the hot and cold fluids to the other ends of the manifold, those ends without intermeshed passages. Thus the ducts, an intermeshing passage manifold, a heat exchanger core, another intermeshing passage manifold and the ducts will be connected serially. The number and orientations of the modules comprising the manifolds may be varied to suit the desired heat exchanger geometry and the geometry of the ducts conveying the hot and cold fluids. A heat exchanger embodying intermeshing passage modules will have an overall cross-section congruent with the connecting ducts.

Mixing devices for mixing a hot fluid with a cold fluid or two different fluids may be constructed by connecting the two ducts conveying the fluids to the end of the manifold without intermeshed passages and connecting a single duct to the end of the manifold with intermeshed passages.

The embodiments of the invention in which an exclusive property or privilege is claimed are defined as follows:

1. An intermeshing passage manifold adapted for connecting ducts each conveying different fluids to the ends of a heat exchanger core comprising;

(a) one primary and an integral number of secondary manifold sections adjacent successively in an end-to-end manner (b) each of said manifold sections comprising a plurality of passage modules adjacent in a side-by-side manner (c) each of said passage modules including a pair of similar twisted passages enveloped by four module side partitions to maintain the shape of the cross-sections of the module similar along the length thereof (d) said twisted passages in each of said modules being separated by a flowguide partition; each of said flowguide partitions comprising a continuous surface bound by six adjoining lines, one of each of said lines being contained within each of the four module side partitions and each of the two end planes of said module, each of said flowguide partitions serving to transform the cross-sectional configuration of said pair of twisted passages so that the orientation of said cross-sectional configuration of said twisted passages at one end of said module end planes is substantially at right angles to the orientation of said cross-sectional configuration of said twisted passages at the other of said module end planes (e) said primary manifold section having one layer of passage modules oriented so that when said two ducts are connected to it at one end, the two passages defined by said ducts are subdivided into separate adjacent intermeshed passages at the other end (f) each of said secondary manifold sections having a plurality of layers of passage modules adjacent in a side-by-side manner (g) each of said secondary manifold sections contains a larger number of passage modules than the preceding manifold section such that an integral number of passage modules of each of the secondary manifold sections is aligned and congruent with each of the passage modules of the preceding manifold section (h) said passage modules being oriented so that the passages at the end of the manifold which is opposite to that end to which the said ducts are connected are separate adjacent intermeshed passages.

2. An intermeshing passage manifold as defined in claim 1 in which at least only the primary manifold section is adapted to be connected to said core.

3. An intermeshing passage manifold, as defined in claim 1, wherein each of said flowguide partitions comprises a multiplanar surface bound by six adjoining straight lines.

4. An intermeshing passage manifold, as defined in claim 1, wherein each of said flowguide partitions comprises a contoured surface bound by said six adjoining lines, a first number of said lines being curved and a second number of said lines being straight.

5. An intermeshing passage manifold, as defined in claim 1, adaptable for installation in rectangular ducts, having a rectangular cross-section and wherein said passage modules have rectangular cross-sections.

6. An intermeshing passage manifold, as defined in claim 1, adaptable for installation in polygonal ducts, having a cross-section of a polygon and wherein said passage modules have a cross-sectional configuration of a trapezoid.

7. An intermeshing passage manifold, as defined in claim 1, adaptable for installation in annular ducts, having a cross-section of an annulus and wherein said passage modules have a cross-sectional configuration of segments of a circle having two of said side partitions being radial and two of said side partitions being concentric curved surfaces.

* * * * *